US006443148B1

(12) United States Patent
Rodocker

(10) Patent No.: US 6,443,148 B1
(45) Date of Patent: Sep. 3, 2002

(54) HYPERBARIC OXYGEN THERAPY SYSTEM

(75) Inventor: Donald L. Rodocker, Bellevue, WA (US)

(73) Assignee: Hyperbaric Management Systems, Inc., La Jolla, CA (US)

( * ) Notice: Subject to any disclaimer, the term of this patent is extended or adjusted under 35 U.S.C. 154(b) by 0 days.

(21) Appl. No.: 09/338,623

(22) Filed: Jun. 23, 1999

Related U.S. Application Data

(60) Provisional application No. 60/094,333, filed on Jul. 28, 1998.

(51) Int. Cl.[7] ..... A61G 10/00

(52) U.S. Cl. ..... 128/202.12; 128/205.26

(58) Field of Search ..... 128/202.12, 202.26; 49/42, 44, 45, 46

(56) References Cited

U.S. PATENT DOCUMENTS

| | | | | | |
|---|---|---|---|---|---|
| 179,414 | A | | 7/1876 | Kelly | |
| 826,029 | A | * | 11/1906 | Harper | |
| 2,752,114 | A | | 6/1956 | Calvy | |
| 3,216,716 | A | | 11/1965 | Lunde et al. | |
| 3,587,574 | A | * | 6/1971 | Mercer | 128/204 |
| 4,011,867 | A | | 3/1977 | Arntzen | |
| 4,102,545 | A | * | 7/1978 | Jay | 292/57 |
| 4,227,346 | A | * | 10/1980 | Kubik | 49/425 |
| 4,227,524 | A | * | 10/1980 | Galerne | 128/205.26 |
| 4,262,447 | A | * | 4/1981 | Schneier et al. | 49/254 |
| 4,509,292 | A | * | 4/1985 | Konle | 49/499 |
| 4,557,073 | A | * | 12/1985 | Sandling | 49/41 |
| 4,633,859 | A | * | 1/1987 | Reneau | 128/205.26 |
| 4,838,332 | A | * | 6/1989 | Meenek | 160/90 |
| 4,891,911 | A | * | 1/1990 | Yung | 49/404 |
| 4,956,952 | A | * | 9/1990 | Bancroft | 52/207 |
| 5,031,860 | A | * | 7/1991 | Ruiz et al. | 244/118.5 |
| 5,120,094 | A | * | 6/1992 | Eaton et al. | 292/159 |
| 5,188,099 | A | * | 2/1993 | Todeschini et al. | 128/205.26 |
| 5,239,781 | A | * | 8/1993 | Napierkowski et al. | 49/501 |
| 5,351,441 | A | * | 10/1994 | Hormann | 49/362 |
| 5,356,185 | A | * | 10/1994 | Cameron | 292/149 |
| 5,421,627 | A | * | 6/1995 | Yane | 292/162 |
| 5,503,143 | A | * | 4/1996 | Marion et al. | 128/202.12 |
| 5,582,574 | A | * | 12/1996 | Cramer | 600/21 |
| 5,647,074 | A | * | 7/1997 | White, Jr. et al. | 4/664 |
| 5,673,874 | A | | 10/1997 | Howard | |
| 5,742,979 | A | * | 4/1998 | Garcia-Hernando | 16/95 R |
| 6,001,305 | A | * | 12/1999 | Mueller | 422/26 |
| 6,131,340 | A | * | 10/2000 | Clark et al. | 49/410 |
| 6,199,331 | B1 | * | 3/2001 | Hunt | 52/207 |

* cited by examiner

*Primary Examiner*—John G. Weiss
*Assistant Examiner*—Mital Patel
(74) *Attorney, Agent, or Firm*—Akin, Gump, Strauss, Hauer & Feld, L.L.P.

(57) ABSTRACT

A hyperbaric oxygen therapy system having a vertically-oriented pressure vessel and a generally rectangular door opening. The hyperbaric oxygen therapy system also includes a door frame sealingly attached to the door opening and a door panel. The door panel has a shape complementary to that of the door frame and is movable between an open position away from the door opening and a closed position adjacent to the door opening. A door support mechanism is attached to the pressure vessel and movably supports the door panel between the open position and closed position. The hyperbaric oxygen therapy system also includes an interlocking mechanism movable between a locked position when the door panel is in the closed position, wherein the interlocking mechanism extends between and secures the door panel and the door frame, and an unlocked position wherein the interlocking mechanism is retracted from one of the door panel and door frame. A gasket is interposed between the door panel and the door frame for sealing the door panel to the door frame when the door panel is in the closed position.

13 Claims, 9 Drawing Sheets

HYPERBARIC OXYGEN THERAPY SYSTEM

CROSS REFERENCE TO RELATED APPLICATION

This application claims priority, under 35 U.S.C. §119(e), to U.S. Provisional Application No. 60/094,333 filed on Jul. 28, 1998, entitled Hyperbaric Oxygen Treatment Chamber, which is incorporated herein by reference in its entirety.

BACKGROUND OF THE INVENTION

The present invention relates to hyperbaric oxygen therapy systems and more particularly to hyperbaric therapy systems permitting ease of entry and adaptation for multiple users.

Hyperbaric oxygen therapy, generally administered in hyperbaric chambers, is indicated for many medical conditions, therapeutic purposes, and training regimens. Hyperbaric treatment can aid in the treatment of many oxygen dependent diseases as well as sports injuries. In the case of sports injuries or training of athletes, benefit can be derived from exercising within hyperbaric chambers. Some of the ailments that can be effectively treated by oxygen therapy in a hyperbaric environment are as follows: carbon monoxide (often seen in burn patients), acute cyanide poisoning, severe blood loss anemia, osteoradionecrosis, aerobic and anaerobic infections with tissue necrosis, air embolism, decompression sickness, skin grafts, gas gangrene, radionecrosis of bone and soft tissue, bone grafts, pre and post surgery, bacteroides infection, acute cerebral edema, intestinal obstruction, acute peripheral traumatic ischemia, chronic skin ulcers, gastric ulcer, fracture healing suturing severed limbs, acute thermal, crush injury, traumatic head and spinal cord injury, osteomyelitis, chronic stroke, decubitus ulcers, trophic skin ulcer, diabetic skin ulcer, multiple sclerosis, decubitus ulcers (bed sores), soft tissue healing (postoperative or postradiotherapy), post stroke, angina, skin ulcers (arterial insufficiency), difficult healing bone (non-union fractures, etc.), neurological insufficiencies, burns cerebral edema, crisis of sickle cell anemia, exceptional blood loss anemia, near drowning, near hanging, severed limbs, ileus, blast injury, hydrogen sulfide poisoning, near electrocution, peyote poisoning, smoke inhalation, induced iatrogenic, spinal cord contusion, physiological transection, partial motor or sensory loss, acute, chronic, acute, relapsing/remitting, chronic progressive, peripheral neuropathy, radiation myelitis, cerebral edema, toxic encephalopathy, vasoenic, traumatic, early organic brain syndrome, small vessel disease, vegetative coma, hypoxia encephalopathy, cranial nerve syndromes, trigemenial neuralgia, optic neuritis, vestibular disorders, sudden deafness, brain stem syndromes, retinal artery occlusion, Charcot Marie's tooth disease, crush injuries compartment syndrome, clostridia myonecrosis, acute and chronic osteomyelitis, fracture/non-union, delayed wound healing, edema under cast, soft tissue swelling, traumatic and cellulitis (infection/mixed flora), acute necrotizing fascitis, severed digits, bone grafting, tendon and ligament injuries, post surgical repair, stump infections, peripheral vascular ulcer, arterial, decubitus, neuropathy related, venous, burger's disease, diabetic retinopathy, retinal vein thrombosis, migraine, pseudomembranous colitis, sickle cell crisis and hematuria, myocardial infarction, radiation cystitis and enteritis, frostbite, retinal artery occlusion, lepromatous leprosy, pneumatosis cystoides intestinalis, rheumatoid arthritis (acute), scleroderma, peptic ulcer, post cardiotomy low output failure, refractory mycoses, hemoglobin poisoning, acute and chronic lower limbs' arteries affections, chronic coronary ischemia, peritonitis, hemoglobin poisoning by carbon monoxide and by barbiturates, posthemorrhagic condition, newly-born and premature babies hypoxia, after radiotherapy and prior to surgery in lung, mouth mucus and uterus cancers, pre-surgery preparation for cardiac acquired or congenital, malformations, to help blood circulation in high-risk surgery, preparation for surgery on the aorta and its cephalic branches, preparation for cardiac malformation surgery, arterial obstructions in the limbs before and after surgery (embolism, traumas, thrombosis), obstructive arteriopathy of the limbs, arteriosclerosis, gas embolism in the blood vessels, ulcers cause by defective blood circulation, heart strain, heart rhythm disturbances, irregular heartbeat, paroxysmal extrasystole, cardiac insufficiency, s in acquired cardiac malformations, cardiosclerosis decompensation, cardiac insufficiency after heart surgery, heart contraction disturbances, cardiopulmonary insufficiency, lung abscess before and after surgery, non specific chronic lung affections with cardio-pulmonary insufficiency signs, stomach and duodenum ulcers, intestinal occlusion, posthemorrhagic syndrome, acute viral hepatitis, with encephalic disturbances, (stages 1 and 2), without encephalic disturbances but with rapid evolution, liver cirrhosis, mechanical jaundice (stoppage of bilious reflux), hepatic insufficiency after resuscitation, toxic hepatitis (hepatotropic poisons), brain vessels, brain ischemia, cranial traumas, posthypoxic encephalopathy, botulism, cervical spinal cord trauma, acute retinal ischemia, retinal dystrophy, diabetic retinopathy, optic neuritis by methanol intoxication, diabetic arteriopathy, diabetic ulcers and polyneuritis, toxic goitre, paradontosis, facial phlegm, maxillary osteomyelitis, necrotic gingivitis and stomatitis, facial actinomycosis, fractured limbs with blood circulation disturbances, fractures in an arteriopathic or diabetic patient, delayed fracture solidification, osteomyelitis, abortion by placental ischemia, threats of abortion of endocrine origin, placental hypoxia, foetal hypoxia, pregnancy neuropathy (stage 1 and 2), pregnancy with immunological conflict, cardiac acquired or congenital malformation, diabetes, coma after eclampsia, asphyxia during delivery, brain blood circulation disturbances, newly-born baby hemolysis, ulcero-neurotic enterocolitis, phlegm, general septic abscess in spite of incision, infectious peritonitis with surgical removal of lesion, chlostridal infection, wound abscess in spite of drainage, prophylactic treatment of wound infected after open trauma, granular wound, wound with superficial, post surgery wound, poisoning of the hemoglobin, chloroxide poisoning, phospho-organic insecticide poisoning (carbophosphorus)

Typically treatment in a hyperbaric chamber is provided by administering up to 100 percent oxygen to the user via a closed-circuit mask, hood, or other device while the hyperbaric chamber is maintained at pressures above ambient pressure. The oxygen is supplied to the user from a supply source external to the chamber. The patient exhales through a closed system back outside the chamber such that the ambient air in the chamber remains less than 23.5% oxygen or is not oxygen enriched. The environment within the chamber is also generally maintained by a source external to the chamber and is generally controlled by a thermostat.

Such chambers are either very small or large and cumbersome and, to accommodate multiple users, the chamber must be correspondingly larger, particularly where users must be in the prone position while inside the chamber. This corresponding increase in size equates to increased cost to manufacture, transport, and, perhaps more importantly, due to the long life span of such chambers, increased cost in terms of floor space required by such chambers. Accordingly, there exists a need for a hyperbaric chamber capable of delivering treatments and therapies, and permitting exercise regimens, that occupies the minimal amount of floor space, yet is adaptable such that as the need for the chamber increases, the chamber can be readily modified to accommodate an increased number of users.

Additionally, due to the design criteria mandated by the pressure differentials between the environments interior to and exterior to the chamber, entry and exit is typically through circular or oval doorways that are too small for an individual to enter without bending over, stepping over a high threshold, or both. This presents great difficulty for individuals with physical ailments upon entry or exit from the hyperbaric chamber.

The present invention provides a unique device, an easy-entry, adaptable hyperbaric chamber, adapted in various ways to provide a temporary environment of elevated pressure. The device is described with respect to specific adaptations thereof, in order to demonstrate certain new features not heretofore available for addressing the problems with prior art devices.

BRIEF SUMMARY OF THE INVENTION

Briefly stated, the present invention comprises a hyperbaric oxygen therapy system having a vertically-oriented pressure vessel with a generally rectangular door opening. The hyperbaric oxygen therapy system also includes a door frame sealingly attached to the door opening and a door panel. The door panel has a shape complementary to that of the door frame and is movable between an open position away from the door opening and a closed position adjacent to the door opening. A door support mechanism is attached to the pressure vessel and movably supports the door panel between the open position and closed position. The hyperbaric oxygen therapy system also includes an interlocking mechanism movable between a locked position when the door panel is in the closed position, wherein the interlocking mechanism extends between and secures the door panel and the door frame, and an unlocked position wherein the interlocking mechanism is retracted from one of the door panel and door frame. A gasket is interposed between the door panel and the door frame for sealing the door panel to the door frame when the door panel is in the closed position.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
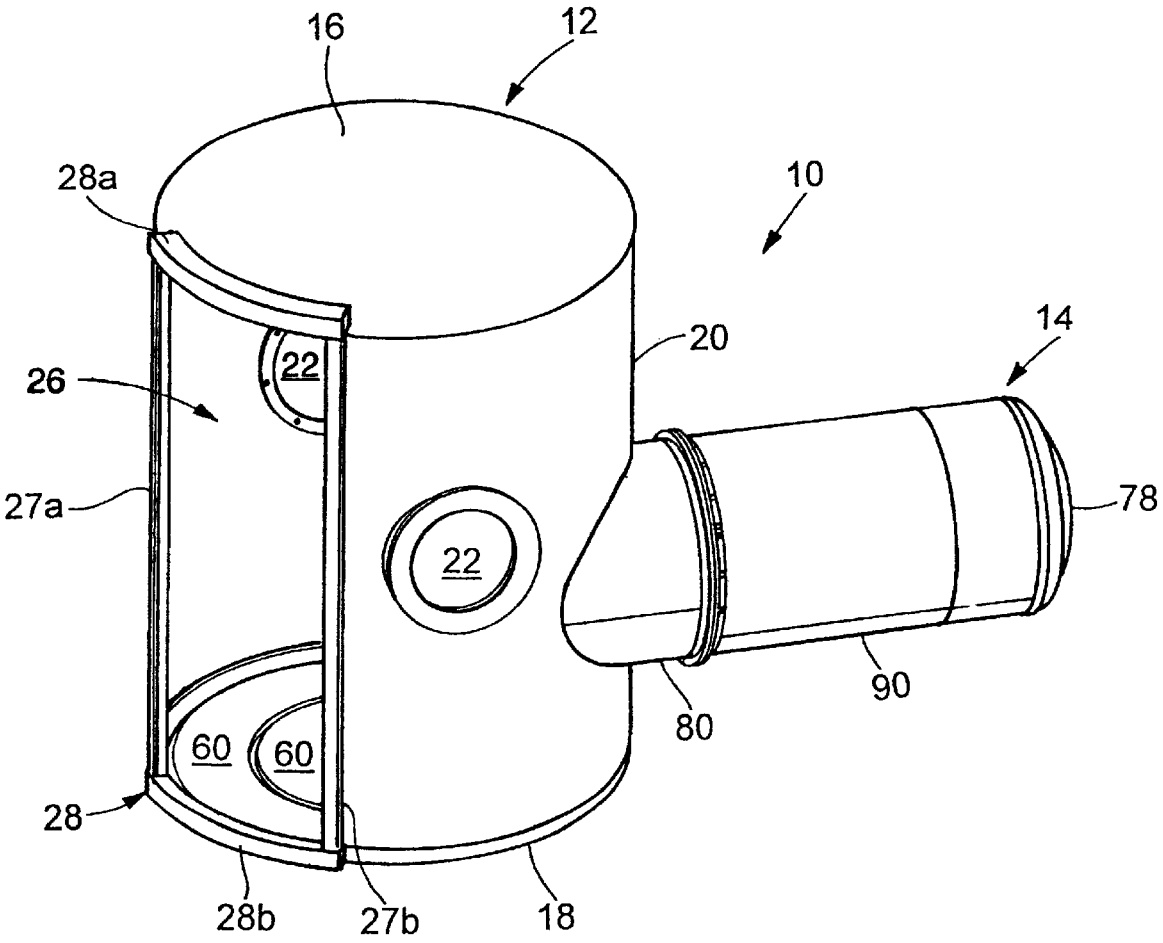
FIG. 1 is a perspective view of the hyperbaric oxygen therapy system in accordance with a preferred embodiment of the present invention.

In the drawings, like numerals are used to indicate like elements throughout. Referring to the drawings in detail, there is shown in FIG. 1 a perspective view, and in FIG. 2 an exploded perspective view, of a hyperbaric oxygen therapy system in accordance with a preferred embodiment of the present invention. The hyperbaric oxygen therapy system includes a hyperbaric chamber 10. The hyperbaric chamber 10 includes a vertically-oriented pressure vessel 12 and a generally horizontal extension chamber 14 within which a user or multiple users, either human or animal (not shown), receive hyperbaric treatment for a multitude of illnesses, impairments, therapies, or for athletic training. Users receive, at hyperbaric pressures (i.e., pressure equal to or greater than 1 atmosphere) treatment of up to one hundred percent hyperbaric oxygen while inside the hyperbaric chamber 10. The hyperbaric chamber 10 is preferably built to American Society of Mechanical Engineers ("ASME") guidelines to withstand the pressure differential between the environments within and outside the hyperbaric chamber 10. Accordingly, except where noted below, each of the parts described herein is preferably made from steel.

In a preferred embodiment, the vertically-oriented pressure vessel 12 is a vertical, generally cylindrical member 20 (hereinafter "vertical cylindrical member 20") having a first end plate 16 and a second end plate 18 sealingly attached to the ends of the vertical cylindrical member 20. Although it is preferred that the pressure vessel 12 is in the form of a vertical cylindrical member 20, it is contemplated that the present invention is not so limited and the vertical cylindrical member 20 could be a multi-sided, vertically oriented structure without departing from the spirit and scope of the invention. The pressure vessel 12 is preferably made from steel and the vertical cylindrical member 20 is preferably rolled into its cylindrical shape. The pressure vessel 12 could be made from any material that would withstand the pressure differential between the environments interior and exterior to the pressure vessel 12.

To improve user comfort and permit users of the hyperbaric chamber 10 to enter or remain in the chamber 10 in the upright position, the height of the pressure vessel 12 is preferably at least that required to permit such standing position of the user. In a preferred embodiment, the diameter of the pressure vessel 12 is such as to permit multiple users to stand or sit in the pressure vessel 12 at one time. As such, the economics of the chamber are increased over smaller units and technicians or physicians may be in the chamber along with the user to provide immediate supervision of treatment or provision of therapeutic services while in the chamber 10. The present invention is not limited to any particular diameter pressure vessel 12. Larger diameters are preferred for treating a larger number of patients. The diameter pressure vessel 12 can be increased without a substantial change in the arrangement of the chamber 10, other than increasing the steel thickness in certain areas to counteract the larger area being pressurized.

To further facilitate use of the hyperbaric chamber 10 by individuals, most particularly those with physical ailments that inhibit mobility, the pressure vessel 12 is preferably provided with a generally rectangular door opening 26, i.e., the top and bottom of the door opening 26 are approximately of equal length and the sides of the door opening 26 are approximately of equal length. Preferably the door opening 26 is sufficiently wide to permit easy entry or exit by a user, sufficiently high to permit entry or exit without the need for the user to bend or lower his or her head, and is positioned on the pressure vessel 12 such that there is virtually no step over height. With regard to providing a door opening 26 that provides no step over height, the door opening 26 may be positioned such that its lower periphery is adjacent to the bottom of the pressure vessel 12, or preferably, a ramp (not shown) is incorporated into the interior and/or exterior of the pressure vessel 12 to eliminate any step over height.

Figure 2:
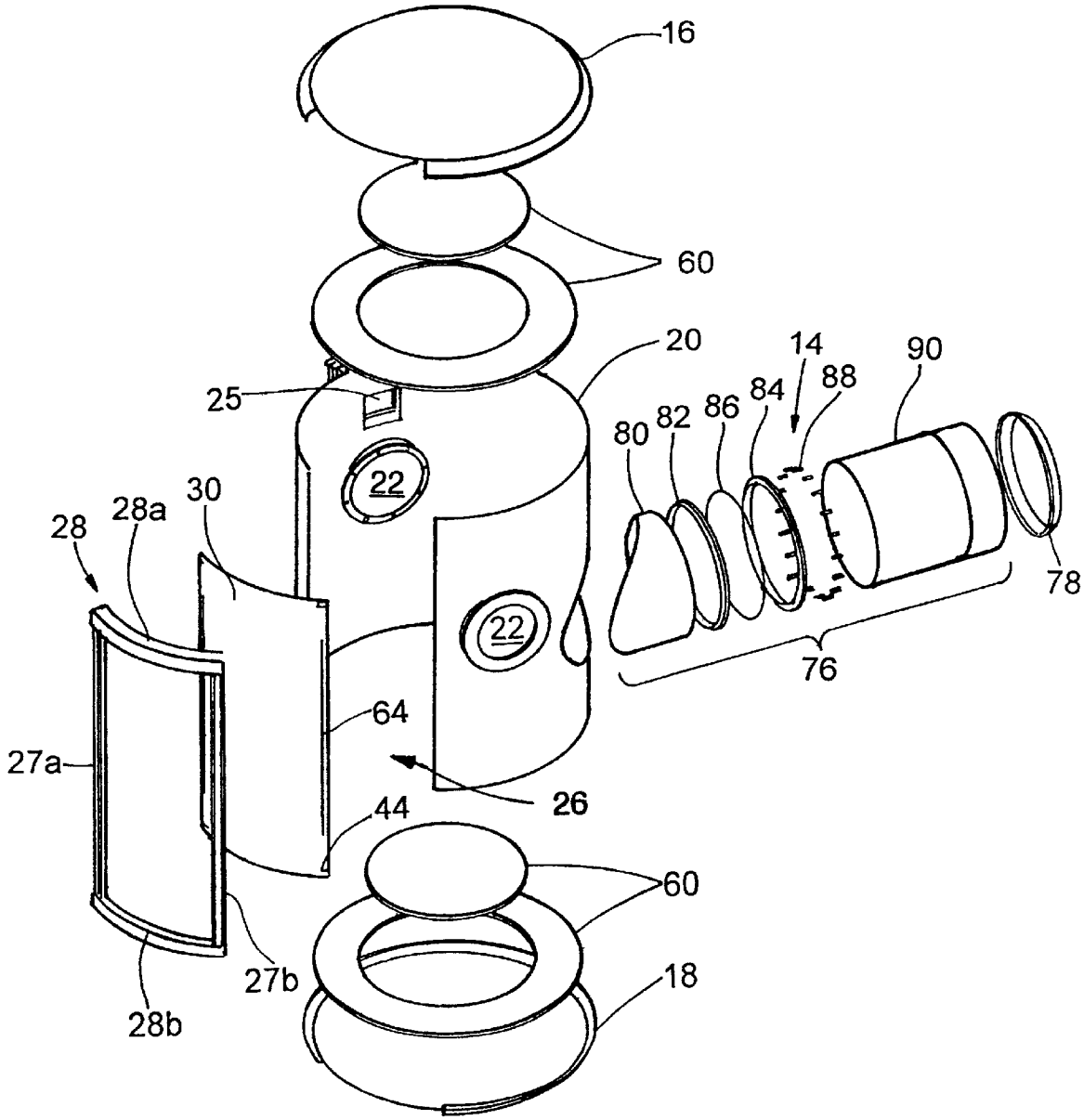
FIG. 2 is an exploded perspective view of the hyperbaric oxygen therapy system as shown in FIG. 1.
Figure 7:
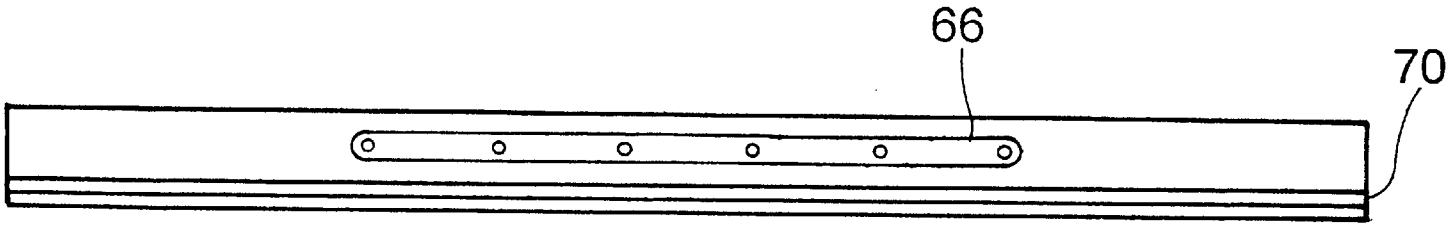
FIG. 7 is a front plan view, rotated 90 degrees, of a preferred embodiment of a vertical member of a door frame of the present invention.
Figure 8:
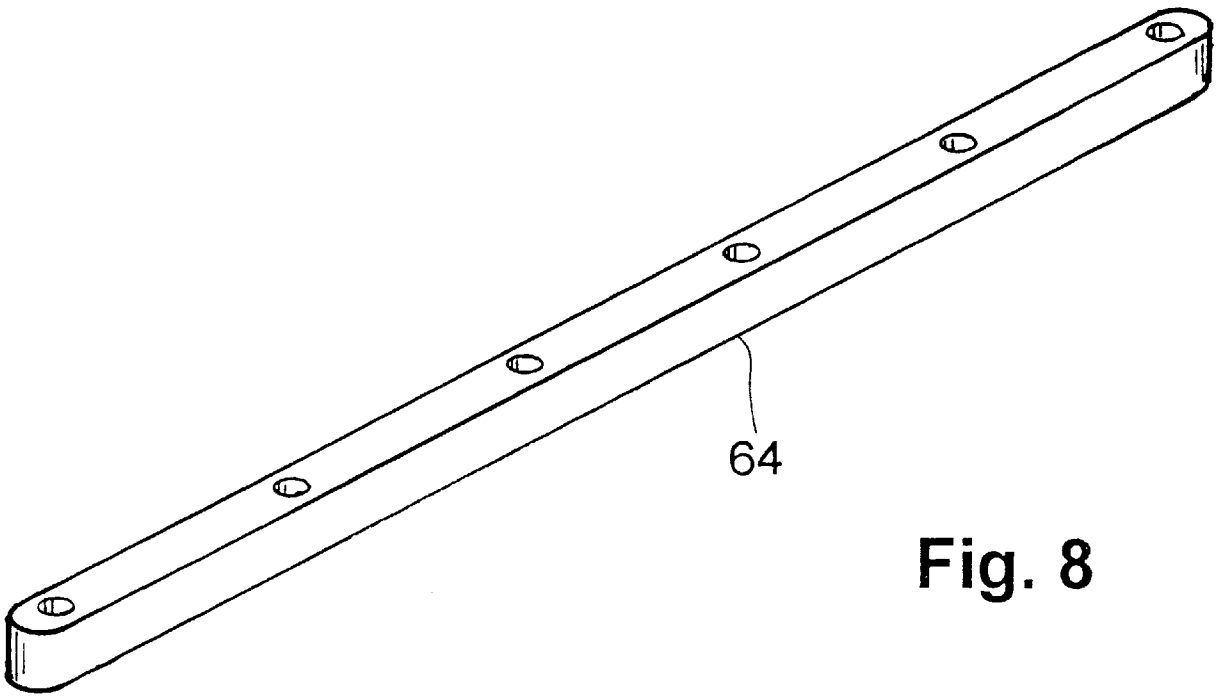
FIG. 8 is a perspective view of a preferred embodiment of a protrusion of the present invention.

As shown in FIG. 2, in a further preferred embodiment, it is contemplated that a door frame 28 is incorporated around the periphery of the door opening 26 and sealingly attached thereto to provide support to the door opening 26. It is contemplated, however, that the door frame 28 is not required and the features of the door frame 28 described hereinbelow may be incorporated directly into the vertical cylindrical member 20. The door frame 28 of a preferred embodiment includes vertical members 27*a,* 27*b* and horizontal members 28*a,* 28*b*. In a preferred embodiment, as best shown in FIG. 7, the vertical members 27*a,* 27*b* are elongated members having a recess 66 and channel 70 therein (the configuration and function of which will be described below). The horizontal members 28*a,* 28*b* are ring segments with a curvature corresponding to that of the vertical cylindrical member 20 and are attached to the vertical cylindrical member 20 and the adjacent first or second end plate 16, 18. The horizontal members 28*a,* 28*b,* need not have a curvature corresponding to the vertical cylindrical member 20, but may have any other curvature or may be straight, depending on design criteria.

Figure 6:
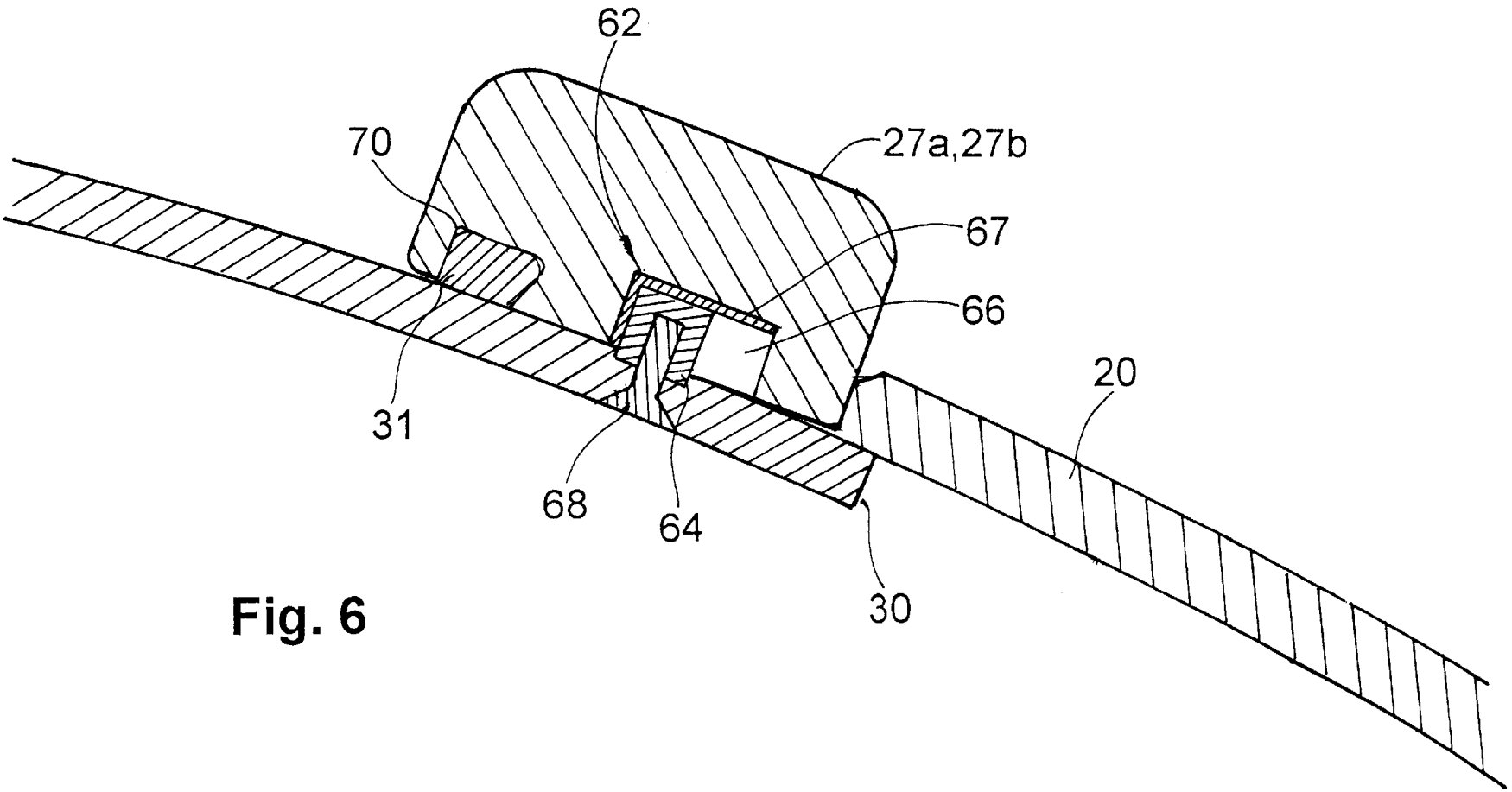
FIG. 6 is a greatly enlarged cross-section view of a preferred embodiment of a vertical member of a door frame, door panel, and vertical cylindrical member of the present invention.
Figure 9:
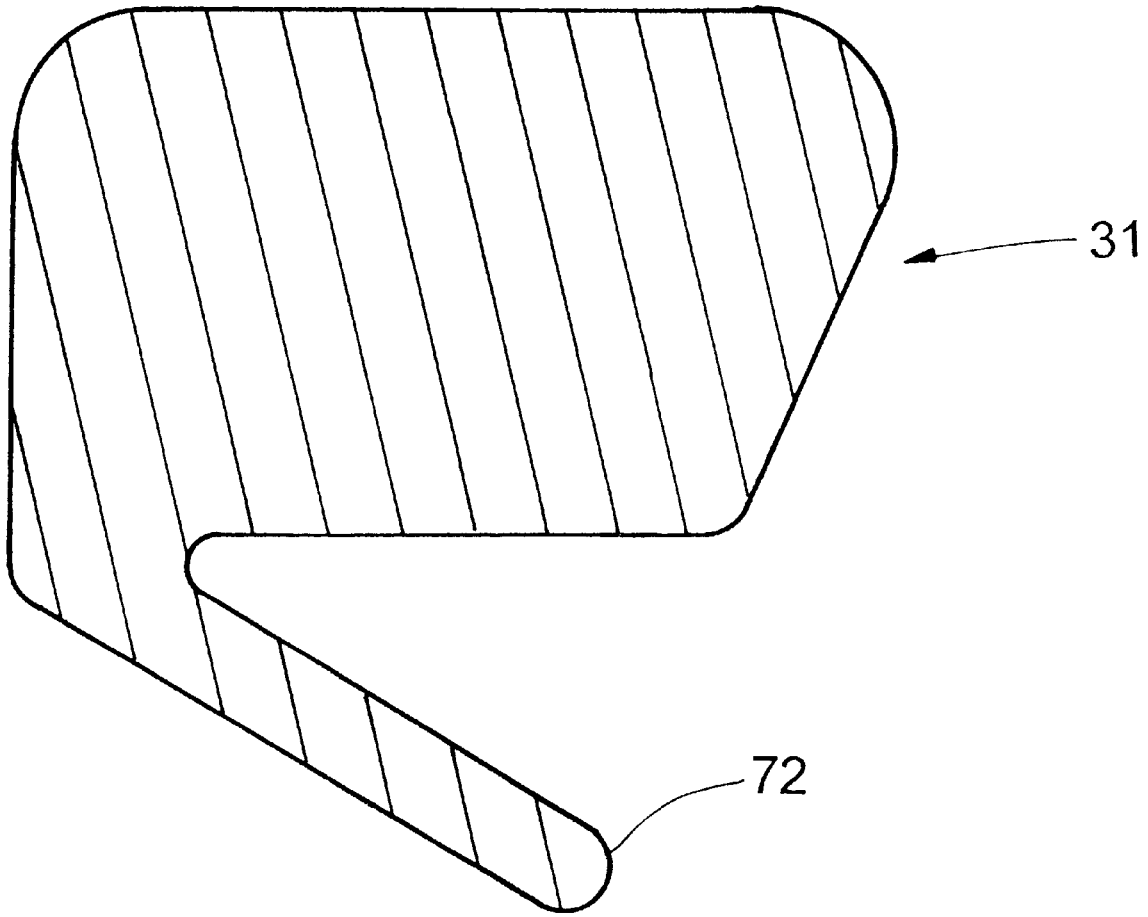
FIG. 9 is a greatly enlarged cross-sectional view of a preferred embodiment of a door gasket of the present invention.
Figure 10:
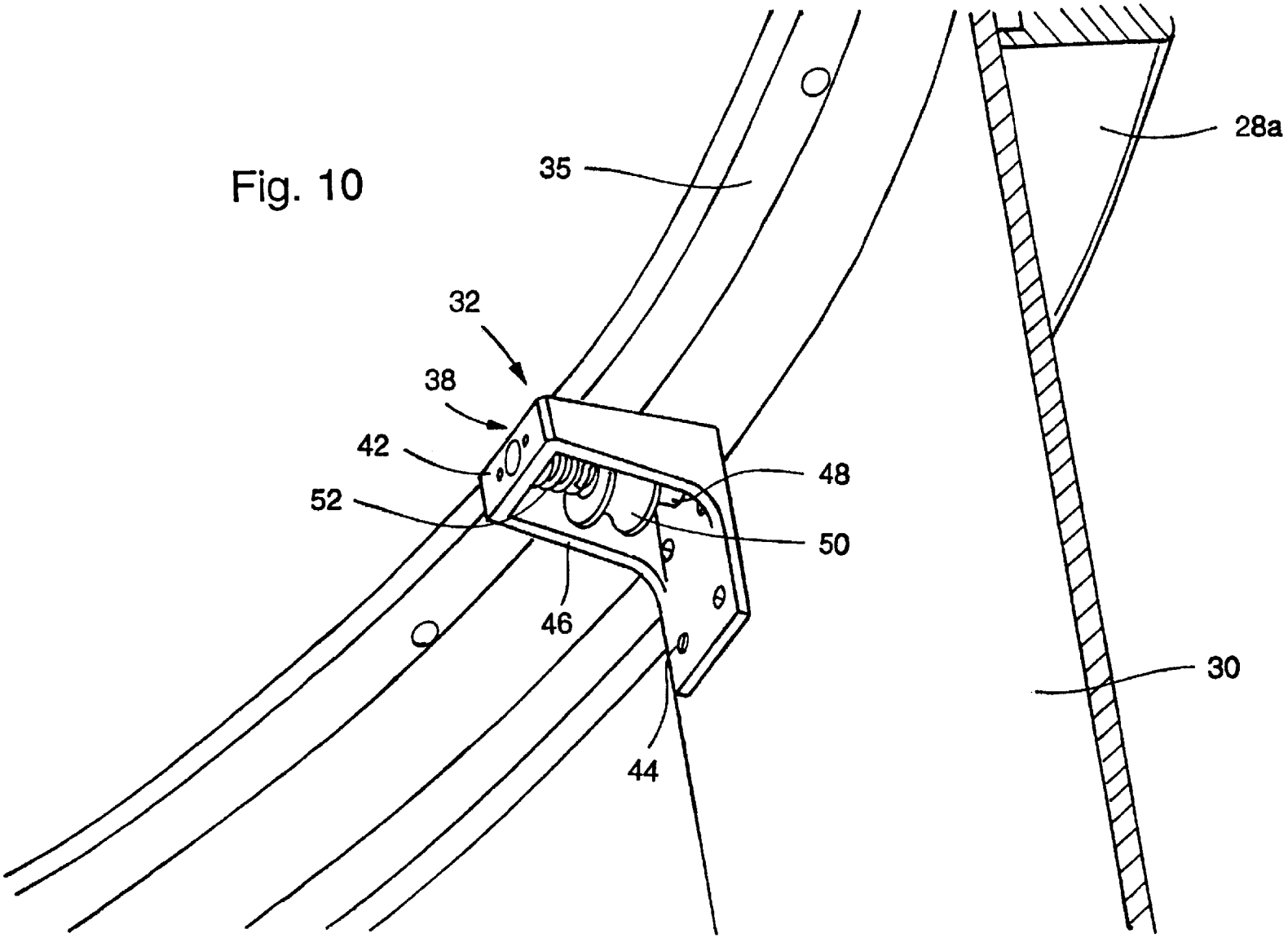
FIG. 10 is a greatly enlarged sectional perspective view showing the upper door support mechanism of a preferred embodiment of the present invention.

As shown in FIG. 6, the door frame 28 includes a channel 70 on the interior-facing surfaces of the vertical members 27*a,* 27*b,* as shown in FIGS. 6 and 7, and horizontal members 28*a,* 28*b*. (In the event no door frame 28 is used, the channel 70 is integrated into the vertical cylindrical member 20 adjacent to the door opening 26). The channel 70 retains a door gasket 31 that acts to seal the door panel 30 (described below) to the vertical cylindrical member 20 or door frame 28 (if a door frame 28 is used) when the door panel 30 is in its closed position. In an alternative embodiment, a channel 70 is incorporated into the door panel 30 such that when the door gasket 31 is seated in the channel 70 the door gasket 31 contacts the door frame 28 or the vertical cylindrical member 20. As best shown in FIG. 9, the door gasket 31 preferably includes at least a single lip 72 that engages the surface of the door panel 30 when the door panel 30 is in the closed position. The door gasket 31 is preferably made from resilient material, such as closed cell foam or an elastomeric compound.

Additionally, to improve user comfort, the pressure vessel 12 is preferably equipped with viewing ports 22, which may reduce the tendency for users and technicians to experience claustrophobia while inside the hyperbaric chamber 10. Such viewing ports 22, further provide technicians stationed outside of the hyperbaric chamber 10 the opportunity to view users without the need to be inside the hyperbaric chamber 10 with the users, thereby increasing the capacity of the hyperbaric chamber 10 to accommodate more users as opposed to technicians. In furtherance of the ability of the technician or therapist to remain outside the hyperbaric chamber 10 during operation, the hyperbaric chamber 10 is provided with a passageway 25, which is a small vestibule or air lock, having inner and outer doors (not shown) for passing objects therethrough without the need to depressurize the hyperbaric chamber 10.

Referring to FIG. 2, the hyperbaric chamber 10 also includes a door panel 30 having a shape complementary to that of the vertical cylindrical member 20 or door frame 28 (if a door frame 28 is used). The door panel 30 is preferably made from steel although other materials may be used without departing from the spirit and scope of the invention, so long as the material has sufficient strength to withstand the pressure differentials across the door panel 30. The door panel 30 is stationed interior to the pressure vessel 12 and is preferably sized to extend beyond the door opening 26 or to overlap the door frame 28 (if a door frame 28 is used). In a preferred embodiment wherein the pressure vessel 12 is in the form of a vertical, generally vertical cylindrical member 20, it is preferred that the door panel 30 be a cylindrical section with a curvature corresponding to the vertical cylindrical member 20. It is not required that the door panel 30 have a curvature, however, and the door panel 30 could be flat so long as a sealing function between the door panel 30 and the pressure vessel 12 or door frame 28 is accomplished and the door panel 30 can withstand the pressure differential without failure. The door panel 30 of a preferred embodiment is movable between an open position away from the door opening 26 and a closed position adjacent to and covering the door opening 26. In a preferred embodiment, it is contemplated that the door panel 30 moves from its closed position adjacent to the door opening 26 in a radially inward direction and then slides or rolls laterally (i.e., around and concentric with the vertical cylindrical member 20) to clear the door opening 26. It is contemplated that the path followed by the door panel 30 between the open and closed positions could vary without departing from the spirit and scope of the invention. For example, the door panel 30 could move in a more conventional single-side hinged fashion whereby the door panel 30 would first slide radially inwardly then swing open rather than slide laterally.

Figure 3:
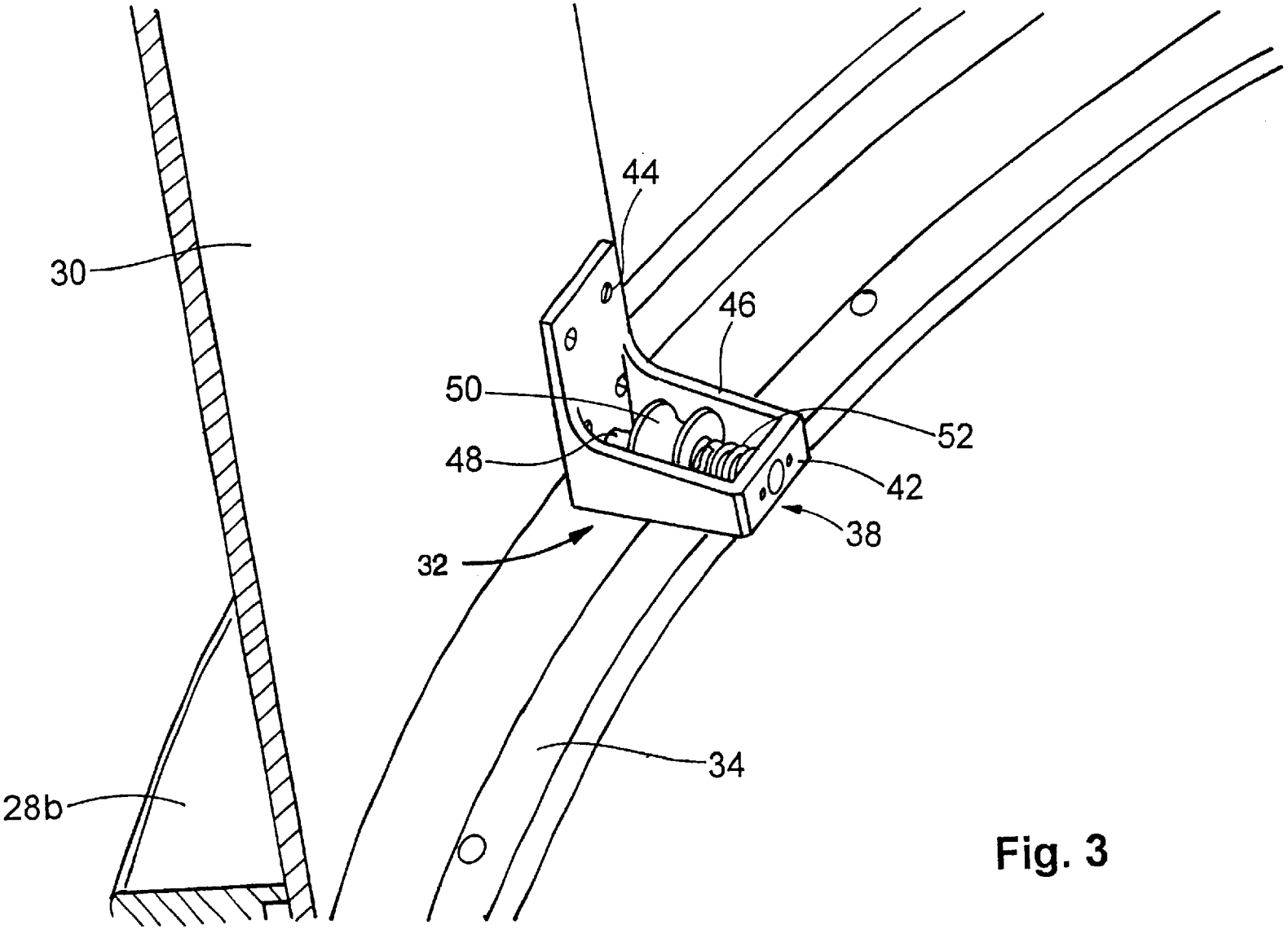
FIG. 3 is a greatly enlarged sectional perspective view showing the door support mechanism of a preferred embodiment of the present invention.
Figure 4:
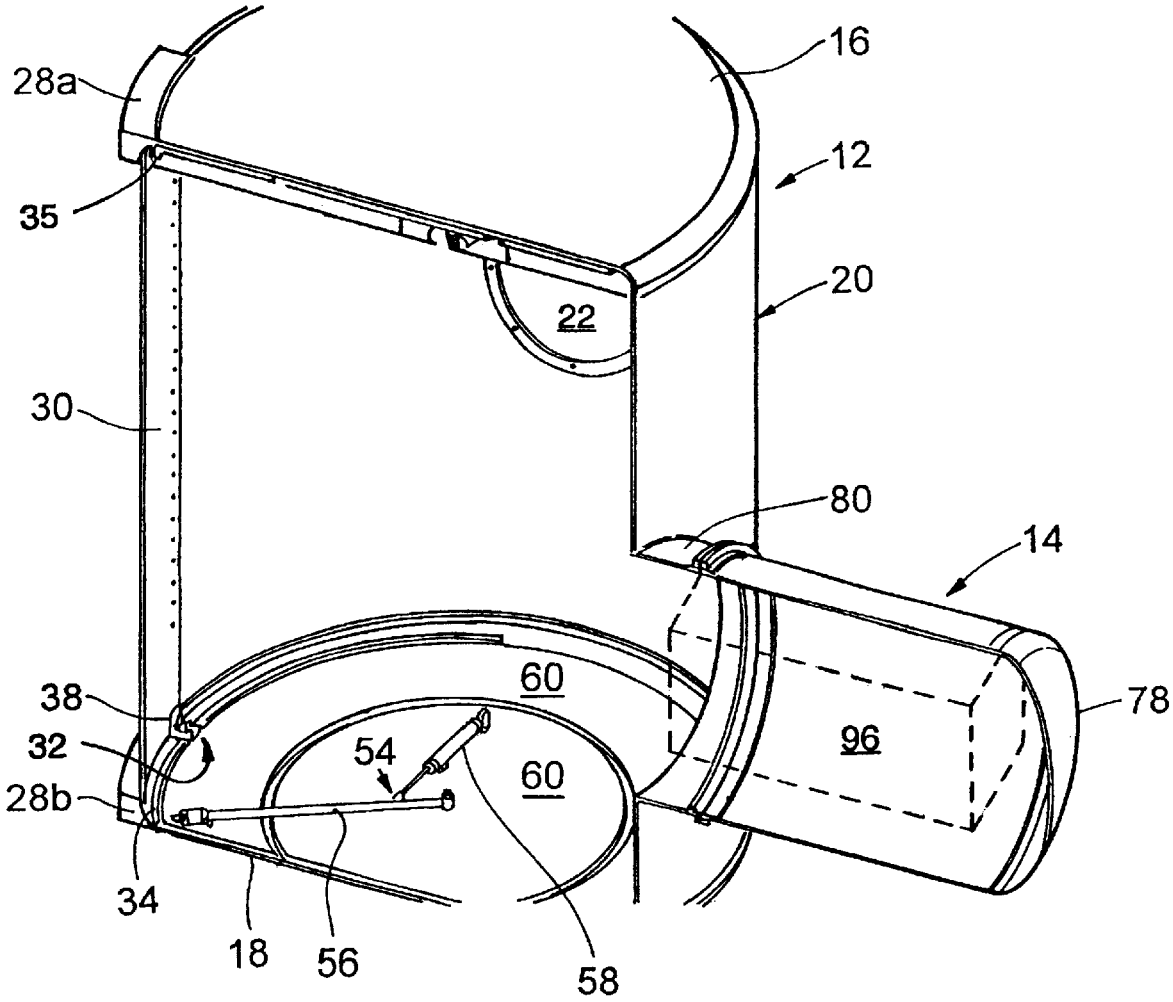
FIG. 4 is a cutaway perspective view of the hyperbaric oxygen therapy system as shown in FIGS. 1 and 2.
Figure 5:
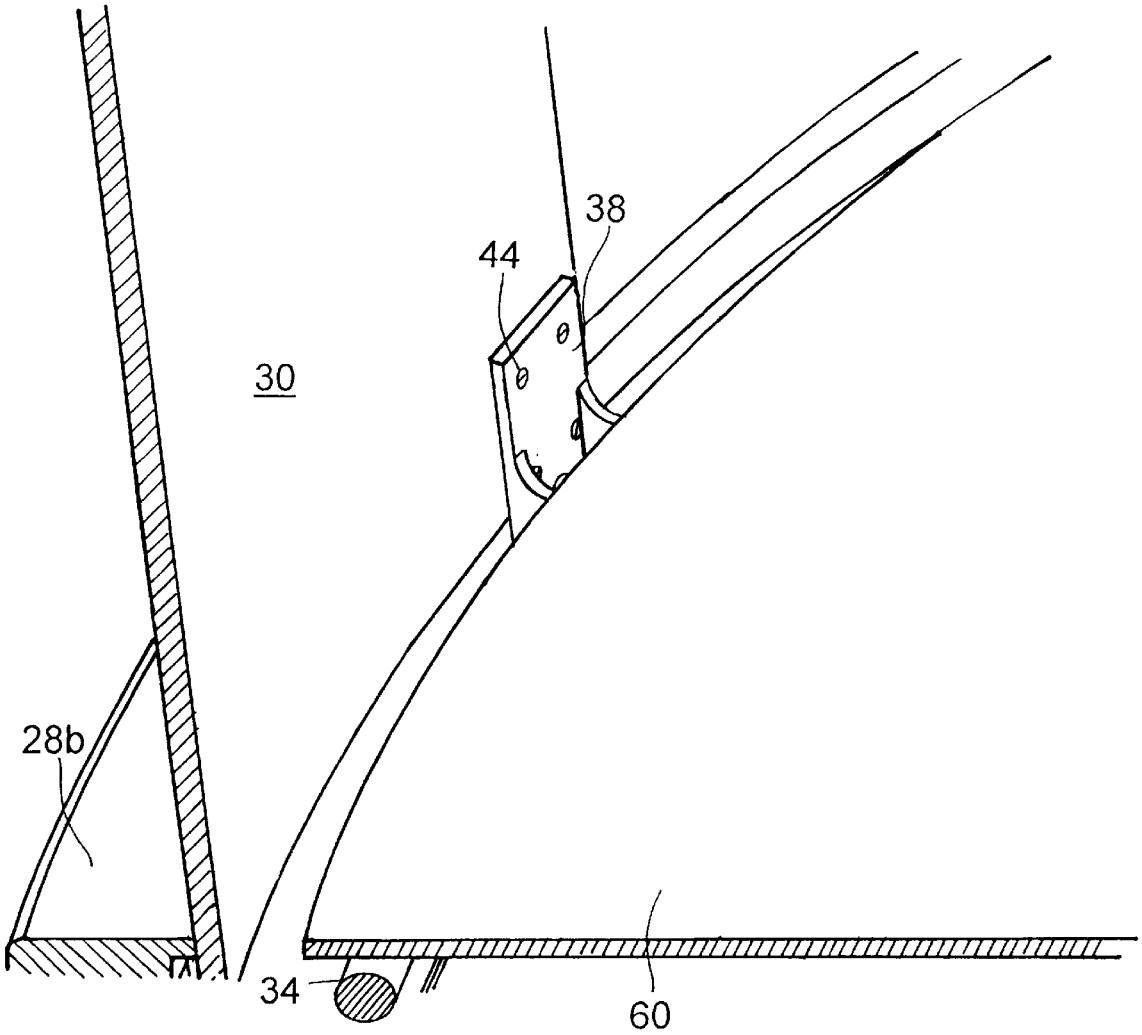
FIG. 5 is a greatly enlarged sectional perspective view of the door support mechanism of FIG. 3, shown with floor panels in place.

As shown in FIGS. 3, 4, and 5, a door support mechanism attached to the pressure vessel 12 movably supports the door panel 30 between the open position and the closed position. The door support mechanism includes a first circumferential rail 34 and a second circumferential rail 35 attached to the pressure vessel 12, preferably adjacent to the top and bottom of the door opening 26. In a preferred embodiment, the first circumferential rail 34 and second circumferential rail 35 are arcuate and have a curvature corresponding to that of the vertical cylindrical member 20 and are spaced from the vertical cylindrical member 20 such that the door panel 30 moves from the open position to the closed position in a path that closely follows the vertical cylindrical member 20. It is contemplated that the first circumferential rail 34 and second circumferential rail 35 need not follow the curvature of the vertical cylindrical member 20, but may follow any other path that takes the door panel 30 away from the door opening 26. It is preferred that the first circumferential rail 34 and second circumferential rail 35 are circular in cross-section for reasons discussed below, however, alternative cross-sectional shapes such as semi-circular, oval, square, etc. can be used with equal effectiveness. The length of the first circumferential rail 34 and second circumferential rail 35 is such as to accommodate movement of the door panel 30 to provide complete clearance of the door opening 26.

The door support mechanism further includes support arms 38, as shown in FIG. 3, attached to the door panel 30 and at least one support arm 38 slidingly attached to the first circumferential rail 34 and at least one attached to the second circumferential rail 35 for supporting the door on the first circumferential rail 34 and second circumferential rail 35. In a preferred embodiment, it is contemplated that there are support arms 38 attached to the first circumferential rail 34 and two support arms 38 attached to the second circumferential rail 35. Two support arms 38 are attached adjacent to each top corner of the door panel 30 on the interior surface of the door panel 30 and two support arms 38 are attached adjacent to each bottom corner of the door panel 30 on the interior surface of the door panel 30. It is considered within the purview of the present invention to use more or fewer support arms 38 to support the door panel 30. For example, it is contemplated that only a single support arm 38 may be used for this purpose so long as the door panel 30 is movable between the open and closed positions.

In a preferred embodiment, the support arms 38 include a support arm bracket 42 which is attached to the door panel 30. The support arm bracket 42 is preferably made of steel or another material having sufficient strength to carry the weight of the door panel 30, and is preferably attached to the door panel 30 by fasteners 44. It is also contemplated that the support arm bracket 42 could be attached to the door panel 30 by any other method, such as adhesives or welding, capable of supporting the weight of the door panel 30. The support arm bracket 42 is generally "L" shaped, the upper portion being attached to the door panel 30 and the lower part extending radially inward from the door panel 30 and forming a box-shaped portion 46. Alternatively, the support arm bracket 42 could have any other shape capable of supporting the door panel 30 on the first circumferential rail 34 and second circumferential rail 35. A spindle 48 is attached at one end to each support arm bracket 42 and extends radially inwardly from the door panel 30. As shown in FIG. 3, in a preferred embodiment, the spindle 48 is captured within the box-shaped portion 46. Preferably the spindle 48 is round in cross-section and is made from a material that resists wear, such as steel, bronze, or a polymer-based material. A roller 50 is slidably and rotatably positioned on the spindle 48 of each support arm bracket 42 and engages either the first circumferential rail 34 or second circumferential rail 35. The rollers 50 that are positioned near the top of the door panel 30 preferably engage the lower surface of the second circumferential rail 35, whereas the rollers 50 positioned near the bottom of the door panel 30 preferably engage the upper surface of the first circumferential rail 34.

As described above, the first circumferential rail 34 and second circumferential rail 35 are preferably circular or semi-circular in cross-section. The rollers 50 have correspondingly curved outer surfaces such that the rollers 50 engage around the first circumferential rail 34 and second circumferential rail 35 and guide the door panel 30 along the path defined by the circumferential rails 34, 35. In a preferred embodiment, the spindle 48 is fixed and the roller 50 rotates as the door panel 30 moves along its path on the first circumferential rail 34 and second circumferential rail 35. In an alternative embodiment (not shown) the spindle 48 and roller 50 are unitary and the unitary assembly is slidably or rollably mounted on the support arm bracket 42. In either event, the door panel 30 is slidably supported by the door support mechanism. Alternatively, sliding members (not shown) could be used rather than rollers 50.

Each support arm 38 further includes a resilient member 52 positioned on the spindle 48 for biasing the roller 50 toward the door panel 30. In a preferred embodiment, the resilient member 52 is a spring as is shown in FIG. 3, but it is contemplated that the resilient member 52 could also be an elastomer or some other biasing material or device.

In operation, a preferred embodiment of the door support mechanism 32 operates as follows. At all points in the opening/closing cycle of the door panel 30, the rollers 50 remain engaged with the first circumferential rail 34 and second circumferential rail 35 to provide support for the weight of the door panel 30 and to define the path of the door panel 30. When the door panel 30 is in the closed position, i.e., sealingly engaging the vertical cylindrical member 20 or door frame 28, the rollers 50 of each support arm 38 are located on the spindles 48 in a position distal from the door panel 30, the resilient members 52 thus being in the compressed state. As the door panel 30 opens, the door panel 30 moves radially inward from its closed position and the rollers 50 slide along the spindle 48 to a point where the rollers 50 are in their natural position biased on the spindles 48 toward the door panel 30. The movement of the door panel 30 away from the door opening 26 provides sufficient clearance between the door panel 30 and the cylindrical member 20 to permit movement of the door panel 30 around the cylindrical member to thereby provide entry/exit clearance. To complete the opening cycle, the door panel 30 is moved either manually or mechanically along the path defined by the first circumferential rail 34 and second circumferential rail 35 to at least a point where the door panel 30 is clear of the door opening 26.

As shown in FIG. 4, in a preferred embodiment, the hyperbaric chamber 10 further includes a door panel actuation mechanism 54 extending between the door panel 30 and the pressure vessel 12 to mechanically move the door panel 30 between the open and closed positions. In a preferred embodiment, the door panel actuation mechanism 54 includes a radial actuator 56 for moving the door panel 30 radially into and out of engagement with the vertical cylindrical member 20 or door frame 28 (if one is used) when the door panel is in the closed position, the radial actuator 56 having a first end attached to the pressure vessel 12 and a second end attached to the door panel 30. Preferably the radial actuator 56 is a piston actuator such as a hydraulic or pneumatic actuator, however, it is contemplated that a servo-mechanical or other motor-driven mechanism (not shown) could also be employed. The door panel actuation mechanism 54 also preferably includes a circumferential actuator 58 for moving the door panel circumferentially (i e., laterally) between positions adjacent to and away from the door opening 26. The circumferential actuator 58 has a first end attached to the pressure vessel 12 and a second end attached to the radial actuator 56. Like the radial actuator 56, the circumferential actuator 58 preferably is a piston actuator such as a hydraulic or pneumatic actuator, however, it is contemplated that a servo-mechanical or other motor-driven mechanism (not shown) could also be employed.

As shown in FIG. 4, in a preferred embodiment, the door panel actuation mechanism 54 is located at the bottom interior of the pressure vessel 12 and attached to the door panel 30 near the bottom of the door panel. Alternatively, it is also contemplated that a door panel actuation mechanism 54 could be located at both the bottom and top interior of the pressure vessel 12 and attached near the bottom and top, respectively, of the pressure vessel 12. As best shown in FIG. 5, by positioning the door panel actuation mechanism 54 at the bottom, or alternatively, bottom and top, of the pressure vessel 12, the door panel actuation mechanism 54 can be substantially hidden beneath the cover plates 60. The cover plates are supported at a level above the second end plate 18 and below the first end plate 16 such that clearance is provided for the door panel actuation mechanism 54. The door panel actuation mechanism 54 can be joined at its ends to the door panel 30 and pressure vessel 12 by any mechanism that would permit positional fixation and rotational movement of the joint.

As best shown in FIGS. 2 and 6, in a preferred embodiment, the hyperbaric chamber 10 further includes an interlocking mechanism 62 movable between a locked position when the door panel 30 is in the closed position, wherein the interlocking mechanism 62 extends between and secures the door panel 30 and vertical cylindrical member 20 or door frame 28, and an unlocked position wherein the interlocking mechanism 62 is retracted from one of the door panel 30 and vertical cylindrical member 20 or door frame 28. In a preferred embodiment, the interlocking mechanism 62 comprises at least two protrusions 64, as shown in FIGS. 2 and 7, mounted on or integral with the outwardly facing surface of the door panel 30 along or adjacent to the vertical edge of the door panel 30. When the door panel 30 is in the closed position, the protrusions 64 engage corresponding recesses 66 preferably formed in the interior-facing sides (i.e., vertical members 27*a,* 27*b*) of the door frame 28 or on the interior surface of the vertical cylindrical member 20 (recesses not shown in the vertical cylindrical member 20). The interlocking mechanism 62 permits the door panel 30 to counteract the hoop stress forces on the door panel 30 during pressurization, thus permitting a lighter weight door panel 30.

In an alternative embodiment, the protrusions 64 could be integrated into the door frame 28 or vertical cylindrical member 20 and the recesses 66 could be incorporated into the door panel 30. Thus, the protrusions 64 and recesses 66 are correspondingly located such that when the door panel 30 is in the closed position the protrusions 64 and recesses 66 engage or interlock to transfer stresses from the door panel 30 to the vertical cylindrical member 20, thereby preventing the door panel 30 from blowing out.

In a preferred embodiment, the protrusions 64 and recesses 66 are elongated ridges and channels, respectively. In other words, the protrusions 64 are vertically oriented ridges or bars attached to the outward face of the door panel 30 adjacent to its vertical edges, a single ridge or bar extending vertically along each vertical edge of the door panel 30. As shown in FIG. 6, the protrusions 64 are, in addition to fixation with fasteners 68, recessed into the face of the door panel 30, thereby increasing strength of the bond between the protrusions 64 and the door panel 30. Alternatively, the protrusions 64 could be bonded or welded to the door panel 30, or the vertical edges of the door panel 30 could be bent so as to form protrusions 64. Alternative embodiments contemplated include protrusions 64 in the form of multiple smaller protrusions, such as studs or pins (not shown), used along each vertical edge of the door panel 30 or along the vertical members 27*a,* 27*b* of the door frame 28. As stated above, the recesses 66 correspond in placement to the protrusions 64 for engagement in the closed position. The recesses 66 are larger than the corresponding protrusions 64 to permit the protrusions 64 to slip into the recesses 66 without impacting on the sides of the recesses 66.

As can be discerned from placement of the protrusions 64 and recesses 66, interlocking of these features when the door panel 30 is in the closed position causes stress resulting from outwardly-directed pressure and circumferential hoop stress to be transferred from the door panel 30 to the vertical cylindrical member 20 thereby preventing the door panel 30 from "blowing out." This configuration permits the use of a rectangular doorway as opposed to prior art circular or oval doorways, thus permitting users to enter and depart the hyperbaric chamber 10 without the difficulties encountered when entering or departing through a circular or oval door opening 26. Additionally, transferring hoop stresses through the door panel 30 provides the benefit of enabling the door panel 30 and door frame 28 to be constructed of thinner material than would otherwise be possible.

In a further alternative embodiment (not shown), the protrusions 64, located on the door panel 30 as described above, engage the edges of the vertical members of the door frame 30, thereby eliminating the need for the recesses 66. In other words, the door frame 28 in set inwardly from the vertical cylindrical member 20 such that the outer periphery of the vertical members of the door frame 28 provides edges that the protrusions 64 could engage when the door panel 30 is in the closed position.

As shown in FIG. 6, the recesses 66 preferably include a striker plate 67 preferably having an "L" shape in cross section. The striker plate 67 protects the recesses 66 from wear from repeated opening and closing of the door panel 30. The striker plates 67 can be replaced when they wear. The striker plates are preferably made from a metal softer than steel, such as brass or bronze, but can be made from any material that will resist wear.

In a further preferred embodiment, the hyperbaric chamber 10 of the present invention includes an extension chamber 14 sealingly attached to the pressure vessel 12 and extending generally horizontally therefrom. The extension chamber 14 includes a generally cylindrical section 76 sealingly attached to the pressure vessel 12 and a cap 78 sealingly attached to the cylindrical section 76. It is intended that the cylindrical section 76 need not be cylindrical, but may also be a multi-sided shape of any length without departing from the spirit and scope of the invention. The cylindrical section 76 includes a collar 80 sealingly attached to the cylindrical section 20, and a first flange 82 sealingly attached to the collar 80. It is preferred that the collar 80 be joined to the first flange 82, and that the collar 80 be joined to the vertical cylindrical member 20 by welding, although other forms of attachment such as bolting (not shown) may be used. The cylindrical section 76 also includes a second flange 84 sealingly attached, again preferably by welding, to a tube 90 which is itself sealingly attached to the cap 78. The first and second flanges 82, 84 are sealed to one another by a gasket 86 and are joined with fasteners 88, thereby providing a means to remove the tube 90 and cap 78. This design provides the benefit of permitting extension chambers 14 to be removed prior to shipment, thereby decreasing size and thus the cost of shipment and permitting the hyperbaric chamber 10 to be placed into rooms that may be inaccessible to hyperbaric chambers having a single, contiguous pressure vessel design. Additionally, by incorporating several collars 80 around the perimeter of the vertical cylindrical member 20, the extension chamber 14 could be added or removed at any time after initial construction of the hyperbaric chamber 10, thus providing design flexibility and capacity for expansion. The extension chamber 14 is preferably made from steel, although other materials could be used so long as they are capable of withstanding the pressure differentials inherent in such chambers.

The extension chamber 14 makes it possible to increase the number of occupants in the hyperbaric chamber 10 without dramatically increasing the footprint occupied by the hyperbaric chamber 10. The extension chamber 14 is preferably long enough to accommodate the a horizontally-disposed individual from feet to at least lower torso, while permitting the head and upper torso to extend into the pressure vessel 12. The extension chamber 14 also permits use of a horizontal exercise machine 96 (shown schematically in FIG. 4) positioned within the extension chamber 14.

In operation, a patient stands, sits, or lies down in the hyperbaric chamber 10. Once the selected pressure is reached within the hyperbaric chamber 10, the patent is given up to one-hundred percent oxygen from a source (not shown) preferably external to the chamber 10. The patient preferably breathes the oxygen from a hood or mask (not shown) into which it is supplied and exhales through a closed system back to external to the chamber 10 such that the ambient air in the chamber 10 remains less than 23.5% oxygen or is not oxygen enriched. A computer controlled system (not shown) controls air pressure and system internal atmosphere (heating, cooling, humidity and removal of excess carbon dioxide) in the chamber 10. The system includes a fire suppression system and smoke detection system (neither shown).

It will be appreciated by those skilled in the art that changes could be made to the embodiments described above without departing from the broad inventive concept thereof.

It is understood, therefore, that this invention is not limited to the particular embodiments disclosed, but it is intended to cover modifications within the spirit and scope of the present invention as defined by the appended claims.

What is claimed is:

1. A hyperbaric chamber comprising:

a vertically-oriented pressure vessel having a door opening;

a door frame sealingly attached to the door opening;

a door panel having a shape complementary to that of the door frame and slidable between an open position away from the door opening and a closed position adjacent to the door opening;

a door support mechanism attached to the pressure vessel, the door panel being slidably supported on the door support mechanism for movement between the open position and closed position;

an interlocking mechanism movable between a locked position when the door panel is in the closed position, wherein the interlocking mechanism extends between and secures the door panel and the door frame, and an unlocked position wherein the interlocking mechanism is retracted from one of the door panel and door frame;

a gasket interposed between the door panel and the door frame for sealing the door panel to the door frame when the door panel is in the closed position; and a door panel actuation mechanism extending between the door panel and the pressure vessel to mechanically move the door panel between the open and closed positions.

2. The hyperbaric chamber of claim 1, wherein the door panel actuation mechanism further comprises:

a radial actuator for moving the door panel radially into and out of engagement with the door frame when the door panel is in the closed position, the radial actuator having a first end attached to the pressure vessel and a second end attached to the door panel; and a circumferential actuator for moving the door panel circumferentially adjacent to and away from the door opening, the circumferential actuator having a first end attached to the pressure vessel and a second end attached to the radial actuator.

3. The hyperbaric chamber of claim 2, wherein the radial and circumferential actuators comprise a piston actuator.

4. A hyperbaric chamber comprising:

a vertically-oriented pressure vessel having a door opening;

a door frame sealingly attached to the door opening;

a door panel having a shape complementary to that of the door frame and slidable between an open position away from the door opening and a closed position adjacent to the door opening;

a door support mechanism attached to the pressure vessel, the door panel being slidably supported on the door support mechanism for movement between the open position and closed position;

an interlocking mechanism movable between a locked position when the door panel is in the closed position, wherein the interlocking mechanism extends between and secures the door panel and the door frame, and an unlocked position wherein the interlocking mechanism is retracted from one of the door panel and door frame; and a gasket interposed between the door panel and the door frame for sealing the door panel to the door frame when the door panel is in the closed position;

the door support mechanism including a first circumferential rail attached to the pressure vessel adjacent to the door opening;

a second circumferential rail attached to the pressure vessel adjacent to the door opening;

a first support arm attached to the door panel and slidingly attached to the first circumferential rail for supporting the door panel on the first circumferential rail; and a second support arm attached to the door panel and slidingly attached to the second circumferential rail for supporting the door panel on the second circumferential rail.

5. The hyperbaric chamber of claim 4, wherein each support arm comprises:

a bracket attached to the door panel, a spindle attached at one end to the bracket and extending radially inwardly from the door panel, a roller slidably positioned on the spindle, and a resilient member positioned on the spindle biasing the roller toward the door panel.

6. A hyperbaric chamber comprising:

a vertically-oriented pressure vessel;

an extension chamber sealingly attached to the vertically-oriented pressure vessel and extending generally horizontally therefrom, the extension chamber including a generally cylindrical section sealingly attached to the vertically-oriented pressure vessel and a cap sealingly attached to the generally cylindrical section, the generally cylindrical section including a collar sealingly attached to the pressure vessel and a tube sealingly and removably attached to the collar; and a horizontal exercise machine positioned within the horizontal chamber.

7. A hyperbaric chamber comprising:

a vertically-oriented pressure vessel having a door opening;

a door frame sealingly attached to the door opening;

a door panel having a shape complementary to that of the door frame and slidable between an open position away from the door opening and a closed position adjacent to the door opening;

a door support mechanism attached to the pressure vessel, the door panel being slidably supported on the door support mechanism for movement between the open position and closed position;

an interlocking mechanism movable between a locked position when the door panel is in the closed position, wherein the interlocking mechanism extends between and secures the door panel and the door frame, and an unlocked position wherein the interlocking mechanism is retracted from one of the door panel and door frame;

a gasket interposed between the door panel and the door frame for sealing the door panel to the door frame when the door panel is in the closed position; and an extension chamber sealingly attached to the vertically-oriented pressure vessel and extending generally horizontally therefrom.

8. A hyperbaric chamber comprising:

a vertically-oriented pressure vessel having a door opening;

a door panel having a shape complementary to that of the pressure vessel and slidable between an open position away from the door opening and a closed position adjacent to the door opening;

a door support mechanism attached to the pressure vessel, the door panel being slidably supported on the door support mechanism for movement between the open position and closed position;

an interlocking mechanism movable between a locked position when the door panel is in the closed position, wherein the interlocking mechanism extends between and secures the door panel and the door frame, and an unlocked position wherein the interlocking mechanism is retracted from one of the door frame and pressure vessel;

a gasket interposed between the door panel and the pressure vessel for sealing the door panel to the pressure vessel when the door panel is in the closed position; and a door panel actuation mechanism extending between the door panel and the pressure vessel to mechanically move the door panel between the open and closed positions.

9. The hyperbaric chamber of claim 8, wherein the door panel actuation mechanism further comprises:

a radial actuator for moving the door panel radially into and out of engagement with the pressure vessel when the door is in the closed position, the radial actuator having a first end attached to the pressure vessel and a second end attached to the door panel; and a circumferential actuator for moving the door panel circumferentially adjacent to and away from the door opening, the circumferential actuator having a first end attached to the pressure vessel and a second end attached to the radial actuator.

10. The hyperbaric chamber of claim 9, wherein the radial and circumferential actuators comprise a piston actuator.

11. A hyperbaric chamber comprising:

a vertically-oriented pressure vessel having a door opening;

a door panel having a shape complementary to that of the pressure vessel and slidable between an open position away from the door opening and a closed position adjacent to the door opening;

a door support mechanism attached to the pressure vessel, the door panel being slidably supported on the door support mechanism for movement between the open position and closed position;

an interlocking mechanism movable between a locked position when the door panel is in the closed position, wherein the interlocking mechanism extends between and secures the door panel and the door frame, and an unlocked position wherein the interlocking mechanism is retracted from one of the door frame and pressure vessel; and a gasket interposed between the door panel and the pressure vessel for sealing the door panel to the pressure vessel when the door panel is in the closed position;

the door support mechanism further comprising a first circumferential rail attached to the pressure vessel adjacent to the door opening, a second circumferential rail attached to the pressure vessel adjacent to the door opening, a first support arm attached to the door panel and slidingly attached to the first circumferential rail for supporting the door panel on the first circumferential rail, and a second support arm attached to the door panel and slidingly attached to the second circumferential rail for supporting the door panel on the second circumferential rail.

12. The hyperbaric chamber of claim 11, wherein each support arm comprises:

a bracket attached to the door panel, a spindle attached at one end to the bracket and extending radially inwardly from the door panel, a roller slidably positioned on the spindle, and a resilient member positioned on the spindle biasing the roller toward the door panel.

13. A hyperbaric chamber comprising:

a vertically-oriented pressure vessel having a door opening;

a door panel having a shape complementary to that of the pressure vessel and slidable between an open position away from the door opening and a closed position adjacent to the door opening;

a door support mechanism attached to the pressure vessel, the door panel being slidably supported on the door support mechanism for movement between the open position and closed position;

an interlocking mechanism movable between a locked position when the door panel is in the closed position, wherein the interlocking mechanism extends between and secures the door panel and the door frame, and an unlocked position wherein the interlocking mechanism is retracted from one of the door frame and pressure vessel;

a gasket interposed between the door panel and the pressure vessel for sealing the door panel to the pressure vessel when the door panel is in the closed position; and an extension chamber sealingly attached to the vertically-oriented pressure vessel and extending generally horizontally therefrom.

* * * * *